US006966767B1

(12) United States Patent
Bianchini et al.

(10) Patent No.: US 6,966,767 B1
(45) Date of Patent: Nov. 22, 2005

(54) SYSTEM FOR MOVING SHEET MATERIAL

(75) Inventors: Alessandro Bianchini, Cognento (IT); Sal DiGrande, Lutz, FL (US)

(73) Assignee: Elopak Systems AG, Glattbrugg (CH)

( * ) Notice: Subject to any disclaimer, the term of this patent is extended or adjusted under 35 U.S.C. 154(b) by 223 days.

(21) Appl. No.: 10/019,536

(22) PCT Filed: Jul. 5, 2000

(86) PCT No.: PCT/EP00/06340

§ 371 (c)(1),
(2), (4) Date: May 14, 2002

(87) PCT Pub. No.: WO01/02276

PCT Pub. Date: Jan. 11, 2001

(30) Foreign Application Priority Data

Jul. 5, 1999 (IT) ..... MO99A0146

(51) Int. Cl.[7] ..... B28B 21/36
(52) U.S. Cl. ..... 425/503; 425/508; 425/510
(58) Field of Search ..... 220/4.24; 53/551, 53/552, 389.2; 425/503, 508, 510

(56) References Cited

U.S. PATENT DOCUMENTS 4,106,261 A 8/1978 Greenawalt
4,382,762 A * 5/1983 Schepp ..... 425/142
4,869,048 A 9/1989 Boeckmann
5,046,659 A * 9/1991 Warburton ..... 220/4.22

FOREIGN PATENT DOCUMENTS

EP 0 881063 A 12/1998
WO 89 00949 A 2/1989

* cited by examiner

*Primary Examiner*—Stephen Castellano
(74) *Attorney, Agent, or Firm*—Reising, Ethington, Barnes, Kisselle, P.C.

(57) ABSTRACT

An apparatus (2) comprises: first clamp means (30) for indexing sheet material (6, 10) through its own forming means (24, 26, 28), further clamp means (52; 54) for advancing said sheet material (6; 10) towards said first clamp means (30) synchronously; the first clamp means (30) and/or the further clamp means (52; 54) are coupled to electronic control means and are mechanically disconnected to each other; a method comprises: indexing sheet material (6, 10) through its own forming means (24, 26, 28) by acting on a region of said sheet material (6; 10), controlling said advancing by acting on a further region of said sheet material (6, 10) disposed upstream said region; said advancing and said controlling take place by using electronic auxiliary means; a container comprises first and second wall means connected to each other along a peripheral sealing (130) in order to define an internal space (132) and regions (104, 110) positioned in a pre-established manner on faces (106, 112) of said wall means.

10 Claims, 6 Drawing Sheets

SYSTEM FOR MOVING SHEET MATERIAL

The invention relates to method and apparatus for transferring and positioning sheet material, as well as a container manufactured from sheet material.

Prior art comprises blow-thermoforming machines in which sheet material is unwound from a single reel, or from a pair of reels, placed side by side, and is indexed through at least one pre-heating station, at least one sealing station and at least one forming station.

In the at least one pre-heating station the sheet material is advanced between heating plates which increase the temperature of the sheet material substantially up to the softening temperature and prepare the sheet material to thermoforming; in the at least one sealing station sealing mould elements join together opposing strip portions of sheet material along outlines of at least one row of container preforms, so that in each container preform openings are formed through which a forming fluid is injectable; in the at least one forming station the forming fluid is injected into the container preforms through the above mentioned openings and expand the container preforms into hollows of at leat one forming mould, so that rows of preforms are turned into respective rows of containers.

The sheet material is indexed through the above mentioned stations by a first moving clamp disposed downstream of the at least one forming station and a second moving clamp disposed upstream of the at least one preheating station, the first moving clamp and the second moving clamp being mechanically coupled by a set of levers to a main driving shaft of the machine.

This implies firstly a disadvantage consisting in that, designing and manufacturing of the set of levers is complicated; furthermore, it is very difficult to modify their specific performances in use, which could be required for operational needs.

Thermoformed containers formed by means of such machines generally bear printed regions comprising wordings and/or images (for example for advertisements or adorning) which are pre-printed on the reels and thus the sheet material has to be indexed of accurate steps, in such a way as the above-mentioned printed regions are centered with respect to the at leat one sealing mould and the at least one forming mould. Therefore, the above mentioned sets of levers show a further disadvantage consisting in that, it is difficult to vary the indexing step of the sheet material; in effect, in order to do so, it is necessary to act on mechanical elements of the sets of levers, with a remarkable waste of time and the need for qualified and export personel.

It is still more difficult to correct the indexing step in order to subject the sheet material, in the section comprised between the first and the second clamp, to a pre-determined elongation for an amount such to adapt the printing step between two rows of consecutive marks to the advancing step of the material through the above described stations. In effect, in order to adapt the printing step to the indexing step, the second clamp are stopped against a fixed stop. Therefore a different adjustment can be carried out only by physically moving the fixed stop to a different position, which involves remarkable expenses and long preparing times.

Furthermore, the blow-thermoforming machines as above illustrated allow the positioning of only one side of the containers, which strongly restricts the aesthetic pleasantness of the containers and constitutes a remarkable obstacle to the diffusion of such containers on the market.

An object of the invention is to improve the systems for positioning of sheet material in blow-thermoforming machines.

Another object of the invention is to allow the advancing step to be adjusted in a faster and easier manner.

A further object is to simplify adjustment of the clamp in order to adapt the advancing step of the sheet material to the printing step.

According to a first aspect of the invention, there is provided apparatus, comprising first clamp means for indexing sheet material through forming means of said sheet material, further clamp means for indexing said sheet material toward said first clamp means substantially synchronously with said first clamp means, characterized in that said first clamp means and/or said further clamp means are coupled to non-mechanical control means.

Advantageously, said non-mechanical control means comprises electronic control means.

Owing to this aspect of the invention, there is no need for mechanical coupling between the first clamp means and the further clamp means.

This greatly simplify manufacturing of the machine and adjustment of the stroke of the first and/or further clamp means.

According to a second aspect of the invention, there is provided apparatus, comprising first clamp means downstream of forming means for indexing first sheet material and second sheet material joined together by said forming means, second clamp means upstream of said forming means for indexing said first sheet material toward said first clamp means substantially synchronously with said first clamp means, characterized in that, third clamp means are provided upstream of said forming means for indexing said second sheet material toward said first clamp means substantially synchronously with said first clamp means.

Thus, printed regions can be centered on both sides of the container.

Owning to these aspects of the invention, adjustment of the indexing step of sheet material through a blow-thermoforming machine is remarkably easier because complex mechanical connections of the clamps are avoided.

According to a third aspect of the invention, there is provided a container, comprising first and second wall means joined together along a peripheral seal and defining an internal cavity, characterized in that, regions of said wall means extend over pre-determined positions of said first and second wall means.

According to a fourth aspect of the invention, there is provided a method, comprising indexing sheet material through forming means of said sheet material, characterized by controlling indexing of first portions of said sheet material independently of second portions of said sheet material.

From the first and second portions container walls can be formed bearing printed regions.

Thus, thermoformed containers can be manufactured having printed regions on both the first and second wall means.

The invention will be better understood and carried out with reference to the accompanying drawings, which show an indicative and non-restrictive example thereof, wherein.

Figure 1:
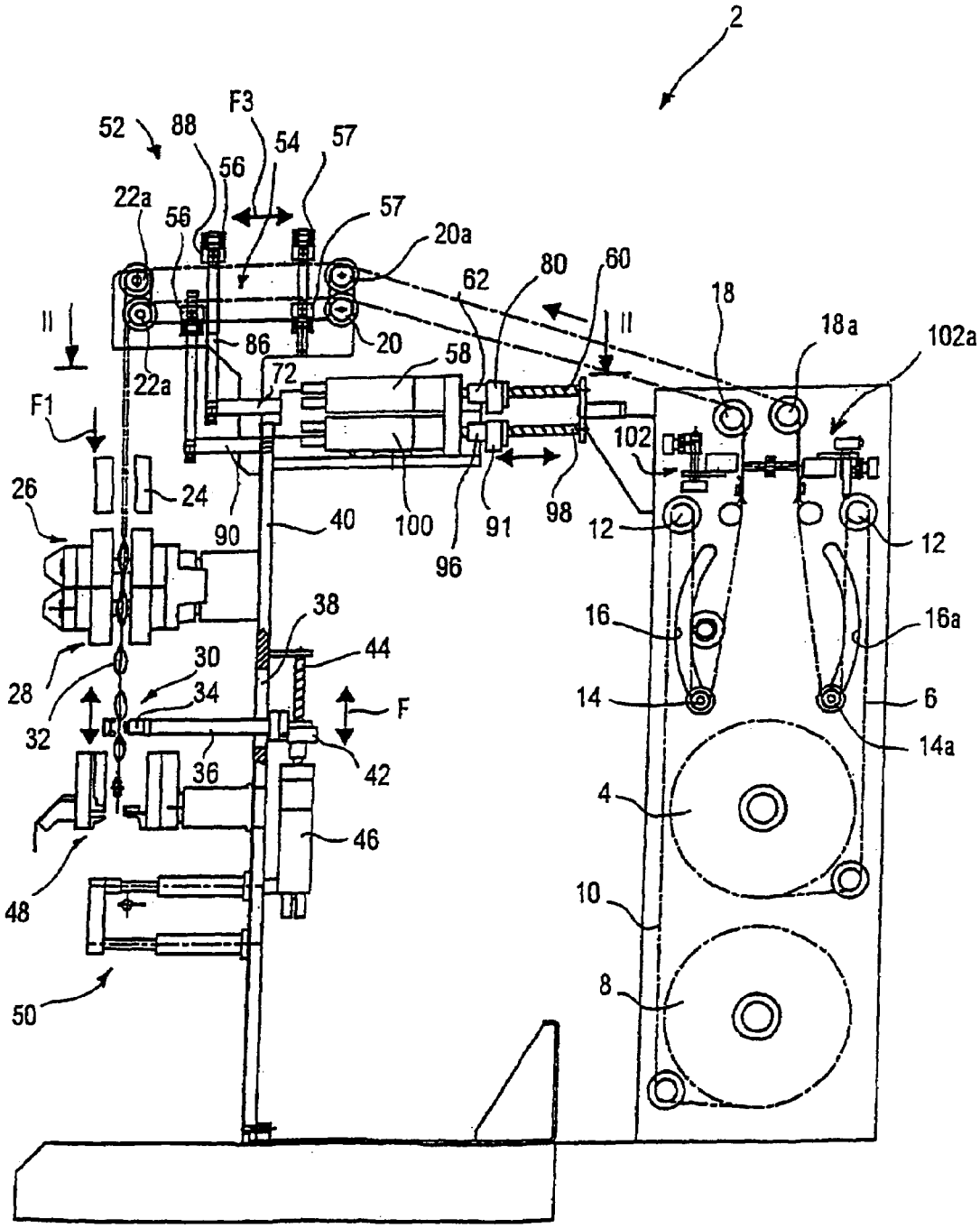
FIG. 1 is a partially sectioned, sketched side view of a blow-thermoforming machine.

As shown in FIG. 1, a blow-thermoforming machine 2 comprises a reel 4 of sheet material 6 and a further reel 8 of further sheet material 10, equal or different from the sheet material 6. The sheet material 6, 10 is partially wound around a first idle roller 12, 12*a*, a tensioner roller 14, 14*a* moving into a curved slit 16, a second idle roller 18, 18*a*, third and fourth idle rollers 20, 20*a*, 22, 22*a* placed in the upper region of the machine 2.

At the exit from the fourth idle rollers 22, 22*a*, the sheets 6, 10 descend into the front part of the machine towards pre-heating means 24, sealing means 26 and forming means 28, at the exit of which containers 32 are obtained from the sheet material 6, 10, generally disposed along parallel rows, still joined together through non-thermoformed portions of the sheet material 6, 10.

First clamp means 30 is provided downstream of the forming means 28, comprising grasping means 34 disposed for acting on the non-thermoformed portions of the sheet material 6, 10 so as to tighten thereon, or release them, the grasping means 34 being fixed to arm means 36 vertically moving as shown by arrow F into a vertical slit 38 of a front wall 40 of the machine 2.

The arm 36 is coupled to a lead nut 42 engaged onto a screw 44 operated to rotate around its longitudinal axis by an electric motor 46 electronically controlled, for example a c.c. motor with encoder.

Through a suitable rotation or the screw 44, the first clamp means 30 can be caused to descend and lift and in particular the first clamp means 30 grasps the non-thermoformed portions of the sheet material 6, 10 when these are in their upper position and release them when these are in their lower position.

The grasp means 34 is controlled for this purpose pneumatically. This allows to index downward the sheet material 6, 10 as shown by arrow F1.

Cutting means 48 is provided downstream of the first clamp means 30 to separate the rows of containers 32 from the sheet material 6, 10 and direct them to the subsequent filling and final closing unit 50.

Second clamp means 52 is provided between the third idle rollers 20, 20*a* and the fourth idle rollers 22, 22*a*, to interact with the sheet material 6.

Third clamp means 54 are provided below the second clamp means 52 to interact with the further sheet material 10.

The second clamp means 52 and the third clamp means 54 are provided with grasping means, generally referred to as 56, similar to the grasping means 34.

The second clamp means 52 is operated by a second electric motor 58, electronically controlled, through a second screw 60 and a second lead nut 62, while the third clamp means 54 is actuated by a third electric motor 100 electronically controlled through a third screw 98 and a third lead nut 92, as it will be shown more in detail in the following.

The second clamp means 52 and the third clamp means 54 are operated to reciprocate along an horizontal direction shown by arrow F3.

Figure 2:
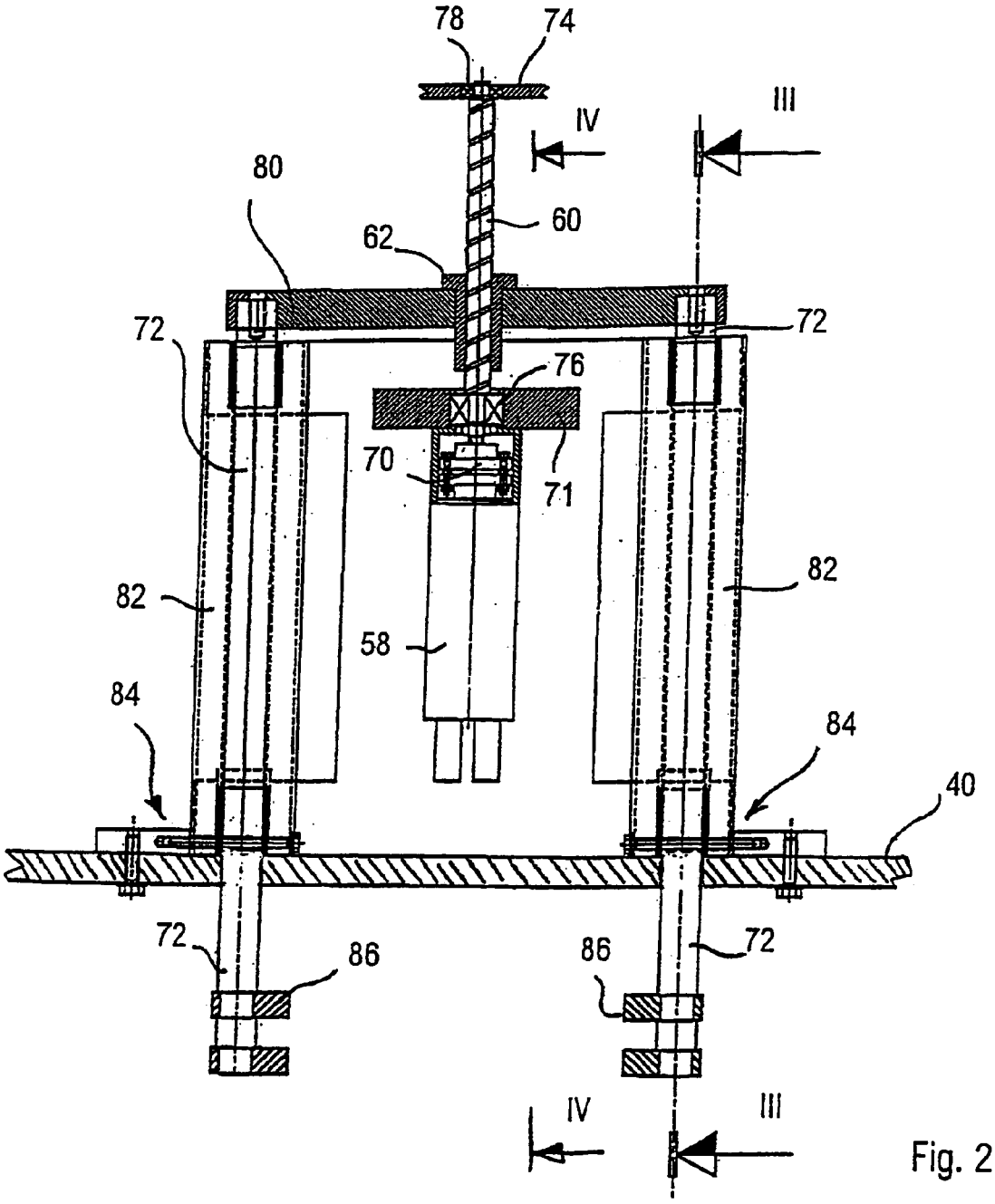
FIG. 2 is a section taken along plane II—II of FIG. 1.

As shown in FIG. 2, the second electric motor 58 is coupled to the second screw 60 through a joint 70 and the second screw 60 is supported at its ends by walls 71, 74 through respective bearings 76, 78. The second lead nut 62 is firmly joined to a cross-bar 80 connected at its final ends to a pair of rods 72 engaged to slide along their longitudinal axis into guide bodies 82 supported, through fixing means 84, to a rear portion of the front wall 40. The rods 72, at their second ends are coupled to uprights 86 interconnected at their upper side by a bar 88 carrying the grasping means 56.

Figure 3:
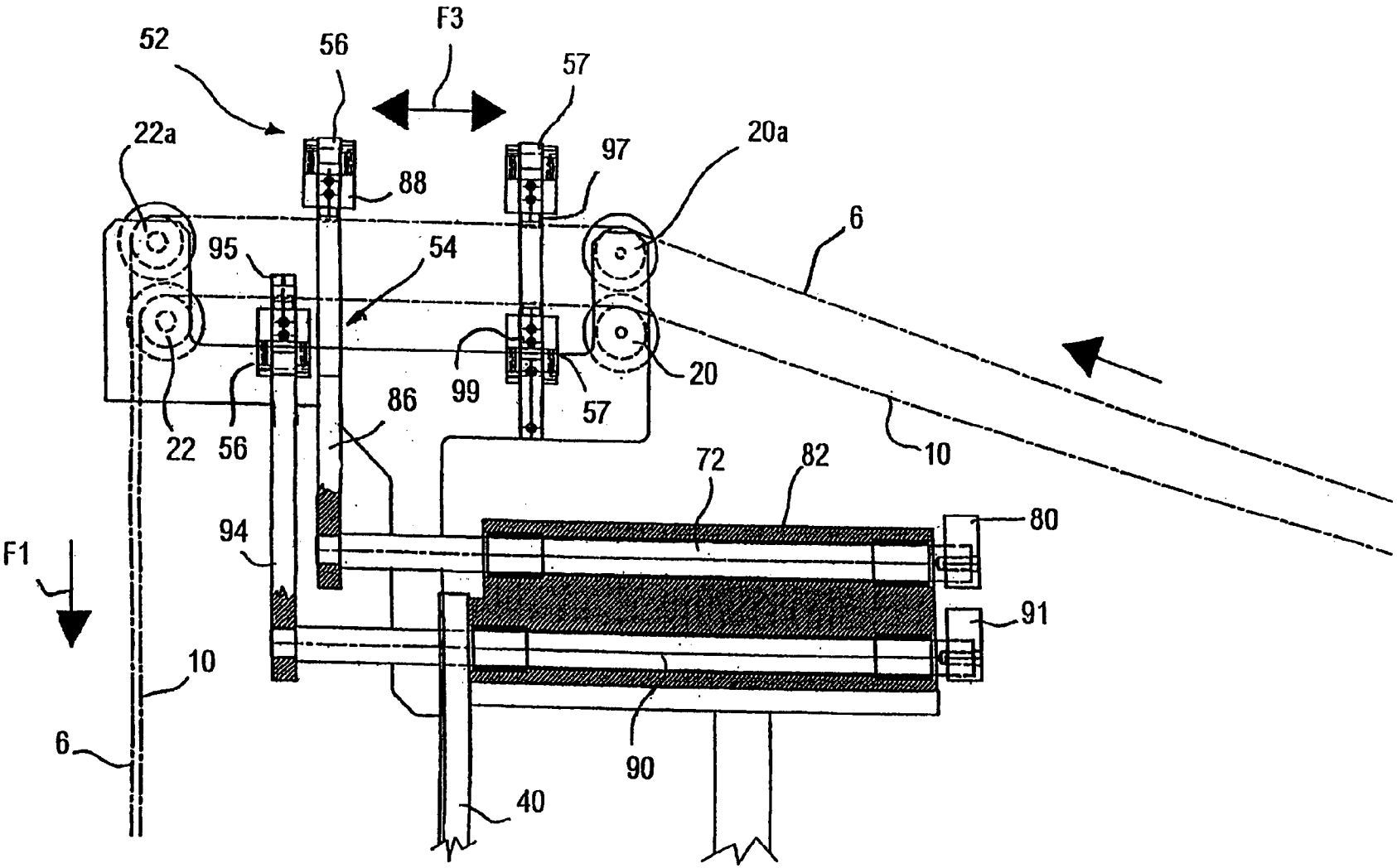
FIG. 3 is a section taken along plane III—III of FIG. 2.

As shown in FIG. 3, the guide bodies 82 slidably receive, below the rods 72, a pair of future rods 90 that extend between a further cross-bar 91, firmly joined to the third lead nut 92, and further vertical rods 94, between which a further bar 95 extends carrying the grasping means 56 of the third clamp means 54.

Upstream of the second and third clamp means 52, 54 further clamp means 57 is provided, similar to the grasping means 34, 56, but supported to fixed cross-bar 97, 99 to interact separately with the sheet material 6, 10.

Figure 4:
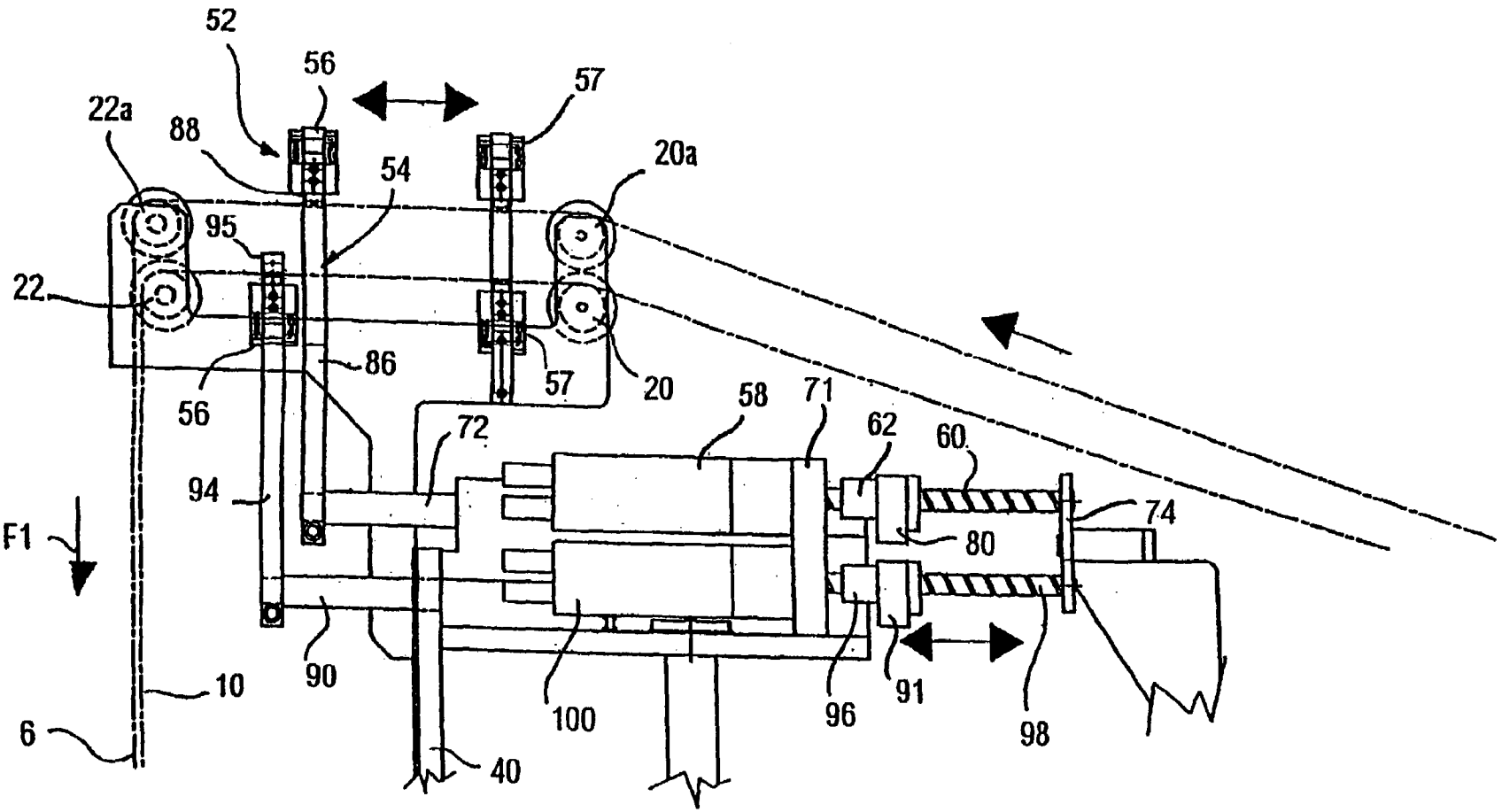
FIG. 4 is a section taken along plane IV—IV of FIG. 2.
Figure 5:
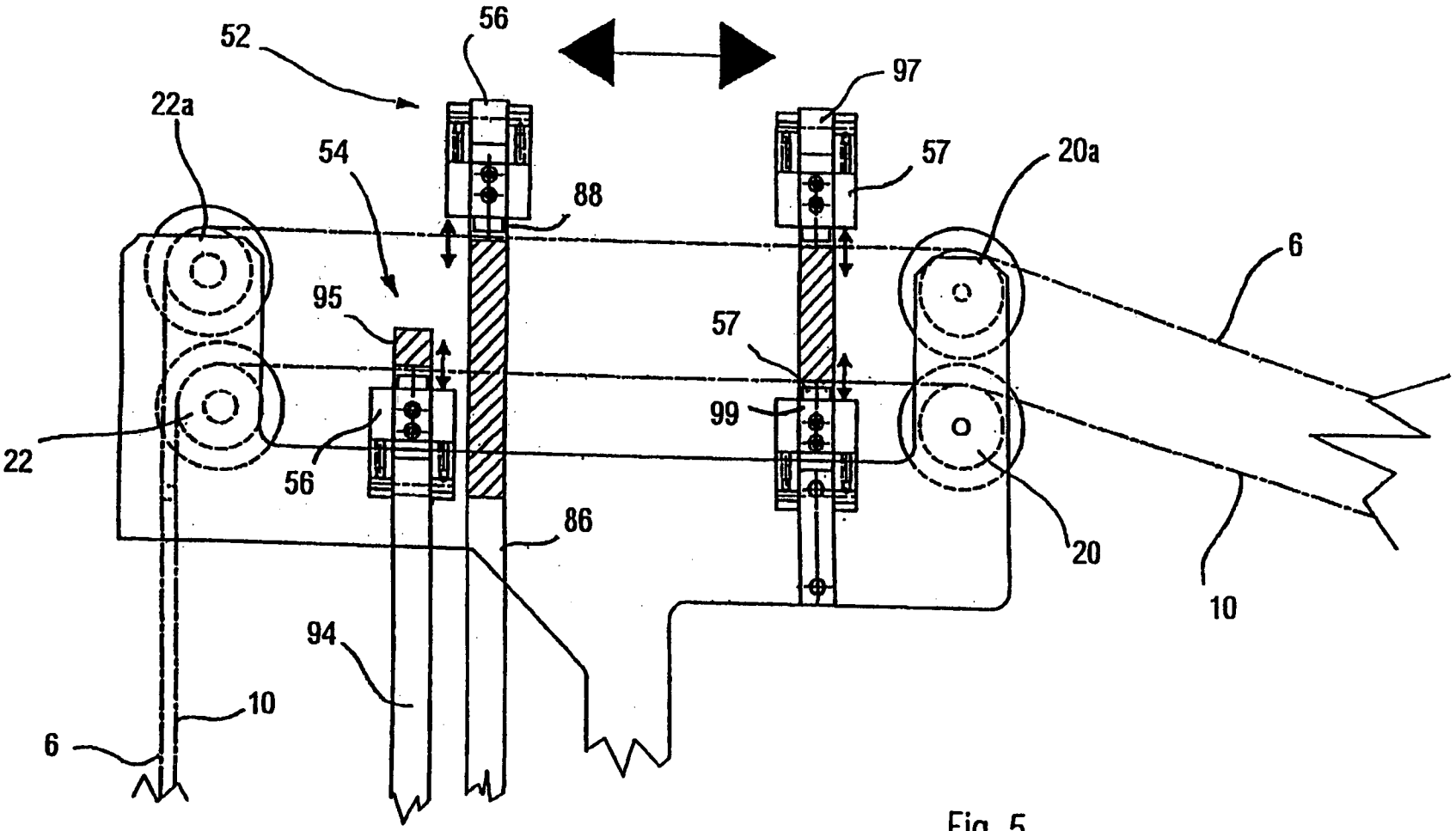
FIG. 5 is an enlarged and broken view of an upper portion of the blow-thermoforming machine of FIG. 1.

As shown in FIG. 4, the further cross-bar 92 is fixed to a further lead nut 96 engaged on a third screw 98 operated to rotate around its own longitudinal axis by a third electronically controlled electric motor 100.

In this manner it is possible to actuate the first clamp means 30, the second clamp means 52 and the third clamp means 54 independently from each other and it is possible to adjust their stroke according to the performance desired to be obtained simply by acting on the software parameters of the control system of the respective motors 46, 58, 64.

The first electric motor determines the advancing step of the sheet material 6, 10 through pre-heating means 24, sealing means 26 and forming means 28.

The second and third electric motor 58, 64 control the adjustment of the printing step according to a sample signal marked on edge regions of the sheet material 6, 10 and detected by detector means 102, 102*a*.

When the detector means 102, 102*a* report that the mark on one or other of the strips of the sheet material 6, 10 varies with respect to the theoretic position, they send a signal to the controlling means of the second and/or the third electric motor 58, 64 in order to produce a corresponding variation of its stroke along the desired direction.

It is also possible to provide a traditional mechanical actuation for the first clamp means 30, for which the adjustment of the stroke is relatively less frequent.

Furthermore, when only the adjustment of the positioning of the sheet material 5, or 6 is required, it is possible to use only the second clamp means 52, or only the third clamp means 54 respectively, in combination with the first clamp means 30.

Figure 6:
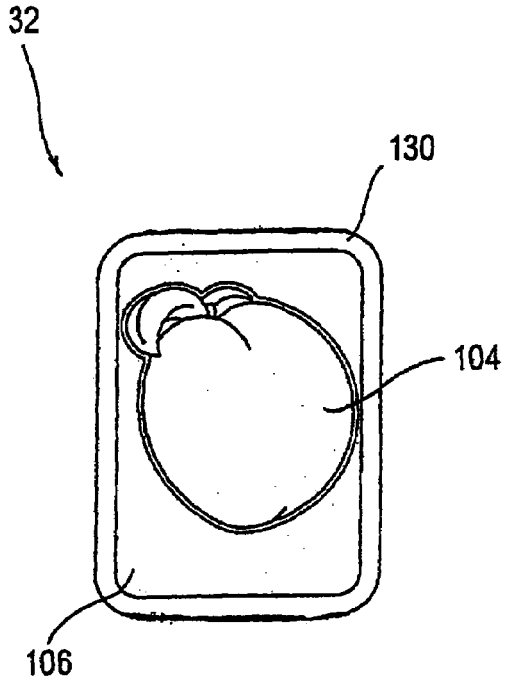
FIG. 6 is a front view of a container with an image printed on one of its faces.
Figure 7:
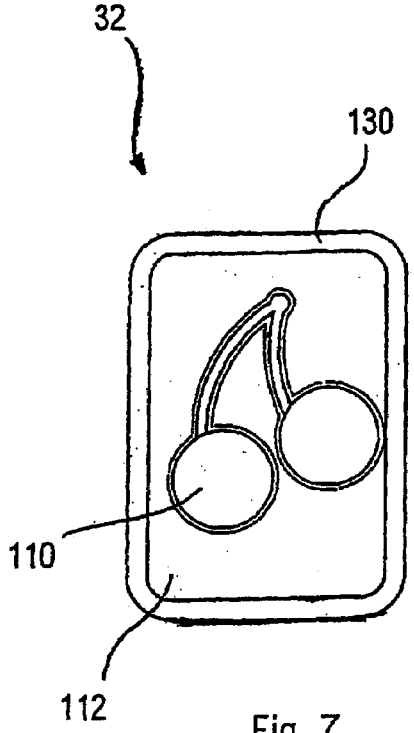
FIG. 7 is a front view of the container of FIG. 6 showing another image printed on the opposite face.
Figure 8:
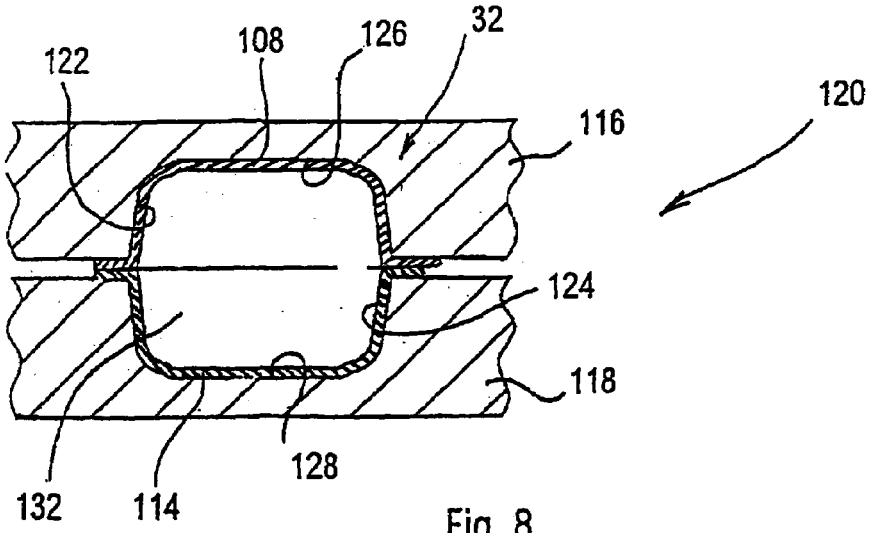
FIG. 8 is a sketched and broken section of the container of FIGS. 6 and 7 inside the forming mould.

As shown in FIGS. 6 to 8, a container 32 formed by the machine 2 shows an image 104 printed on a first wall 106 so as to occupy an embossed portion 108 of the same face; the container 32 has another image 110 printed on a second wall 112 opposed to the first wall 106 so as to occupy another embossed portion 114 of the second wall 112.

The first wall 106 is opposed to the second wall 112 so as the two faces 106 and 112 can be formed by respective parts shown with 116 and 118 respectively of a forming mould 120 comprised in the forming means 28.

The walls 106, 112 of the container 32 are joined together by a peripheral seal 130 and are concave so as to define an internal cavity 132 of the container.

The mould parts 116 and 118 shows respective hollows 122, 124 to form the container 32 and in particular the mould parts 106, 112 are provided with recesses 126, 128 for forming the embossed parts 108, 114 of the container 32.

What is claimed is:

1. Apparatus, comprising forming means for joining first sheet material and second sheet material together, first clamp means downstream of the forming means for indexing the first sheet material and the second sheet material after being joined together by said forming means, second clamp means upstream of the forming means for indexing said first sheet material toward said first clamp means substantially synchronously with said first clamp means, characterized in that, third clamp means are provided upstream of said forming means for indexing said second sheet material toward said first clamp means substantially synchronously with said first clamp means.

2. Apparatus according to claim 1, wherein said first clamp means and/or said second clamp means and/or said third clamp means is coupled to non-mechanical control means.

3. Apparatus according to claim 2, wherein said non-mechanical control means comprises electronic control means.

4. Apparatus according to claim 1, 2 or 3, wherein said first clamp means and/or said second clamp means and/or said third clamp means is/are coupled to a respective electric motor by position control means.

5. Apparatus according to claim 4, wherein said position control means comprises screw means engaged into respective lead nut means to which support means of respective grasping means is coupled.

6. Apparatus according to claim 1 and further comprising fixed grasping means disposed upstream of said further clamp means.

7. Apparatus according to claim 6, wherein said first clamp means and/or said second clamp means and/or said third clamp means is coupled to non-mechanical control means.

8. Apparatus according to claim 7, wherein said non-mechanical control means comprises electronic control means.

9. Apparatus according to claim 6, 7 or 8, wherein said first clamp means and/or said second clamp means and/or said third clamp means is/are coupled to a respective electric motor by position control means.

10. Apparatus according to claim 9, wherein said position control means comprises screw means engaged into respective lead nut means to which support means of respective grasping means is coupled.

* * * * *